US005799818A

United States Patent [19]

Ringer

[11] Patent Number: 5,799,818

[45] Date of Patent: Sep. 1, 1998

[54] COLLAPSIBLE LIQUID CONTAINER

[76] Inventor: Don Ringer, 627 W. Jasper, P.O. Box 377, Goodland, Ind. 47948

[21] Appl. No.: 679,991

[22] Filed: Jul. 15, 1996

Related U.S. Application Data

[63] Continuation of Ser. No. 273,004, Jul. 8, 1994, abandoned.

[51] Int. Cl.[6] ..... B65D 90/04

[52] U.S. Cl. ..... 220/462; 229/117

[58] Field of Search ..... 229/117, 183, 229/185; 220/462, 463, 465, 403

[56] References Cited

U.S. PATENT DOCUMENTS

| | | | |
|---|---|---|---|
| 2,677,495 | 5/1954 | Buttery . | |
| 3,490,581 | 1/1970 | Desmond et al. | 220/462 |
| 3,517,875 | 6/1970 | Wakefield . | |
| 3,952,940 | 4/1976 | Malcolm | 220/462 |
| 4,230,261 | 10/1980 | Austin | 229/117 |
| 4,530,460 | 7/1985 | Hinton . | |
| 4,607,786 | 8/1986 | Weaver | 229/117 |
| 4,815,631 | 3/1989 | Eeg et al. | 220/462 X |
| 4,828,164 | 5/1989 | Passamoni . | |
| 4,890,772 | 1/1990 | Heuberger et al. | 220/462 X |
| 4,899,929 | 2/1990 | Grollman . | |
| 5,042,714 | 8/1991 | Hall | 229/117 |
| 5,054,644 | 10/1991 | Greenslade | 220/465 X |
| 5,161,732 | 11/1992 | Clein et al. | 229/185 X |
| 5,314,088 | 5/1994 | Heuberger et al. | 220/465 |
| 5,419,485 | 5/1995 | Petriekis et al. | 220/465 X |

*Primary Examiner*—Christopher J. McDonald
*Attorney, Agent, or Firm*—Woodward, Emhardt, Naughton, Moriarty & McNett

[57] ABSTRACT

A collapsible liquid container having a flexible liquid tight bag disposed within, and having an integrally formed hand hold. The container comprises a series of generally rectangular sidewall panels interconnected along hinge lines. A plurality of endwall panels are interconnected along hinge lines to the respective sidewalls, forming automatic ends on the container. The automatic ends comprise a pair of opposing interlocking panels that interlockingly engage when the carton is erected. The flexible liquid tight bag has an opening for receiving material therein, and the bag is secured to at least one of the sidewalls. The collapsible container is designed for being shipped or stored in a flat or folded condition, and is manipulated to an unfolded or erect condition when desired to be used, such as to receive a volume of soda, water, or juice.

16 Claims, 5 Drawing Sheets

COLLAPSIBLE LIQUID CONTAINER

This application is a continuation of application Ser. No. 08/273,004, filed Jul. 8, 1994, now abandoned.

BACKGROUND OF THE INVENTION

The present invention relates in general to the design and construction of containers which are utilized for the storage and transportation of substances. More particularly the present invention relates to a collapsible liquid container that can be shipped and stored in a flat or folded condition and when desired for use can be readily manipulated to an erect or unfolded condition.

It is desirable from a logistical, transportation and storage standpoint to utilize a container that is generally shipped and stored in a flat or folded condition rather than in an erect or unfolded condition. The economic savings associated with transporting and storing a container in a flat or folded condition are substantial. However, it is equally important to be able to readily return the container to its erect or unfolded condition. When it is desired to use the container for receiving a quantity of substance, such as water, juice or soda from a dispenser or other source, the collapsed container is manipulated by an attendant from its flat or folded condition into an erect or unfolded condition. In its unfolded condition the container allows the desired substance to be received and stored within the container for the convenience of the consumer and the retailer.

Self-erecting containers for transporting and storing products are well known in the art. In the past, designers of self-erecting containers have generally used a separate closure member placed over the top or bottom of the container to insure that the product dispensed into the container would not spill. The two common approaches of placing a separate closure member over the top or bottom of the container, and the manipulation of flaps, formed integral with the container, into a cover can be a very time consuming task. In a fast paced production environment, such as a modern retail food store, the limitations of the prior containers greatly slow down and burden the counter sales and service staff.

In the prior design and construction of self-erecting containers there generally has been little attention to the environmental impact associated with these products. However, an ever increasing international focus on the environment is drawing attention to the quantity of waste material associated with containers, and has created a demand for new products that are designed for more efficient recycling.

Even with the variety of earlier designs, there remains a need for an improved collapsible liquid container for the storage and transportation of substances. The need remains for a device that minimizes the space required to store and ship a container, and yet does not create a burdensome and time consuming task for an attendant to set-up, fill, and close the container. The present invention satisfies this need.

SUMMARY OF THE INVENTION

To address the unmet needs of prior collapsible liquid containers, one form of the present invention contemplates a self-erecting container, comprising: a plurality of sidewall panels hingedly attached to adjacent ones of the sidewall panels along hinge lines, each of the sidewall panels having a first end and an opposite second end; at least one of the sidewall panels has an opening therein for receiving a bag opening therein; a liquid tight flexible bag within the container for holding a volume of material, at least a portion of the bag being secured to the container with a bag opening in the opening of the sidewall; first and second opposed automatic ends respectively disposed at the first end and the second end of the sidewall panels; and at least one of the automatic ends comprising a plurality of endwall panels hingedly attached to the respective ends of the sidewall panels, one pair of the endwall panels defining opposed interlocking panels that interlockingly engage when the carton is erected, a shortened endwall panel hingedly attached to one of the sidewall panels, the shortened endwall panel hingedly attached to one of the sidewall panels, the shortened endwall panel being shorter than the other endwall panels, and upon erection of the container the shortened endwall panel avoids interference with the fluid tight flexible bag.

It is an object of the present invention to provide an improved collapsible liquid container having these desirable attributes.

It is a further object of the present invention to provide such a collapsible liquid container that can be shipped and stored in a flat or collapsed condition to minimize the amount of space occupied, and at the site of ultimate use be readily manipulated to an unfolded or erect condition.

Further objects and advantages of the present invention will be apparent from the following description.

DESCRIPTION OF THE PREFERRED EMBODIMENT

Figure 1:
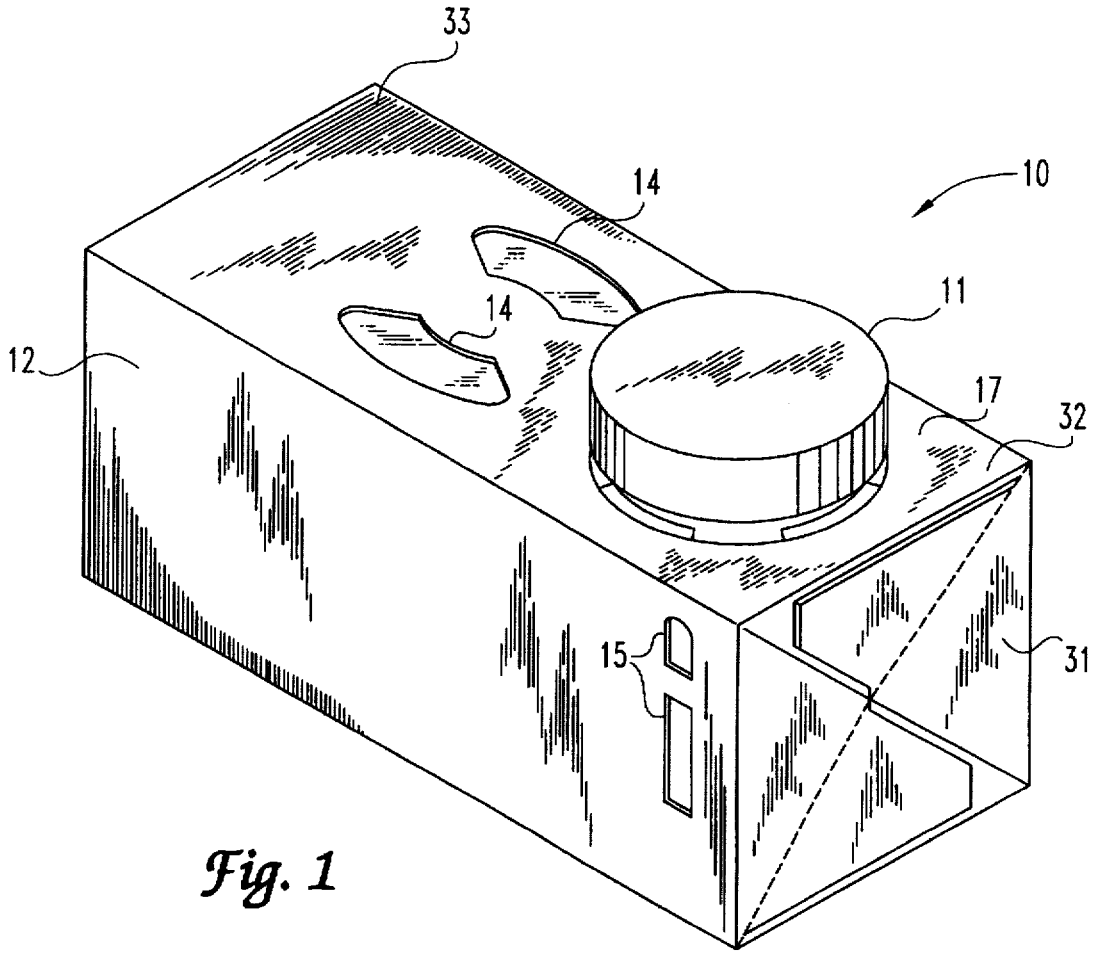
FIG. 1 is a perspective view of the collapsible liquid container according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a collapsible liquid container 10 which is designed and manufactured in accordance with the present invention. Collapsible liquid container 10 is designed for being shipped and stored in a flat or folded condition, and when desired for use as a storage container is manipulated into an erect unfolded condition for receiving a quantity of substance therein. A pair of hand holds 14 are integrated into the container 10 for assisting a consumer or attendant in transporting the container. A detachable lid 11 prevents the material that has been dispensed into the container 10 from being spilled therefrom, and a fill level indicator 15 is integrated into the container 10 for determining the quantity of material.

Figure 2:
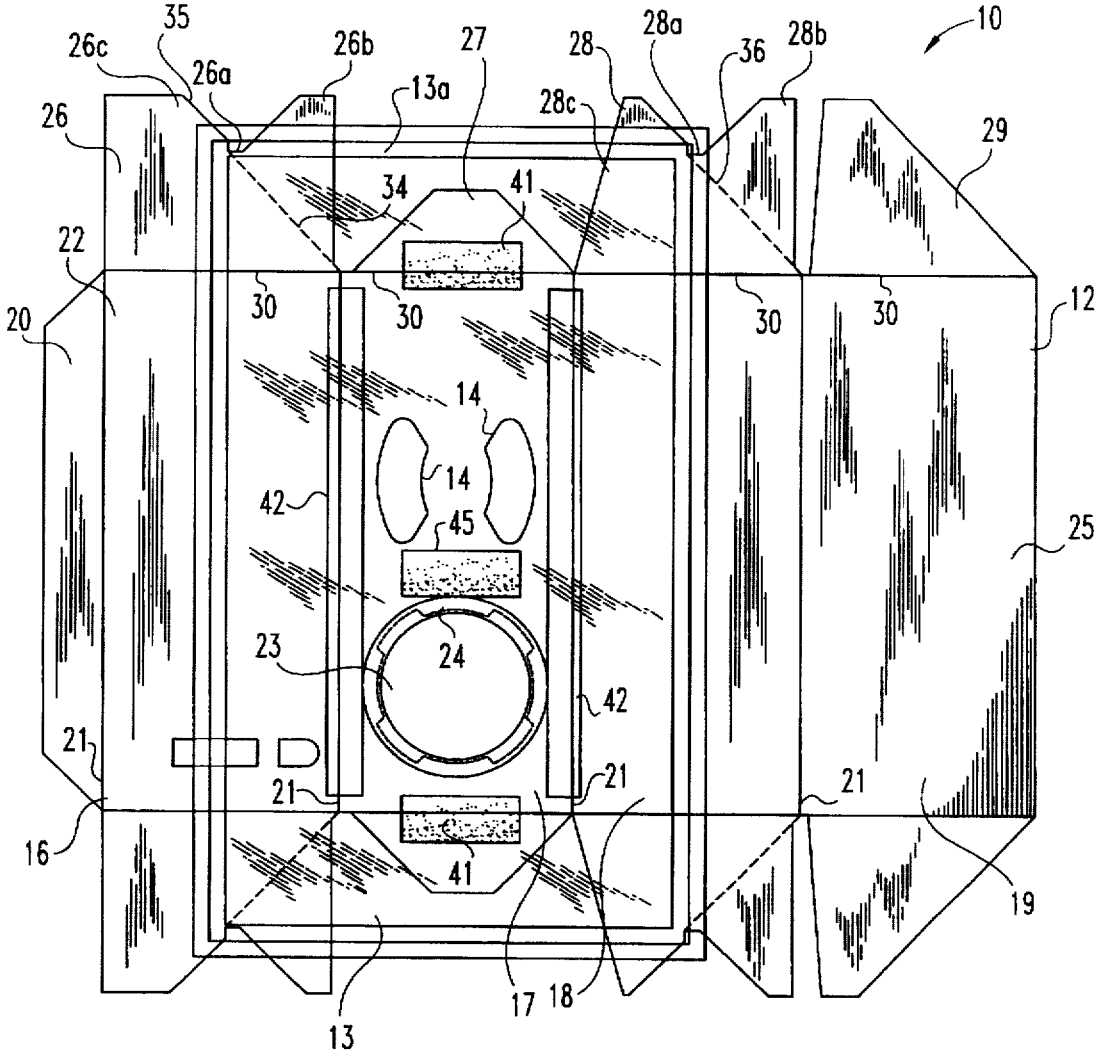
FIG. 2 is a top plan view of a blank for the collapsible container of FIG. 1 with a fluid tight liquid bag attached.

Collapsible liquid container 10 comprises three interengaging components, namely a foldable carton 12, a fluid tight flexible bag 13, and the lid 11. With reference to FIG. 2, there is illustrated an unassembled sheet or blank used in constructing the collapsible liquid container 10. In the preferred embodiment the folded carton 12 is formed from a single sheet or blank 22 of paperboard, corrugated paperboard, or the like with the perforations and folds defined therein. The perforations can be formed as spaced cuts or holes, and the fold lines can be defined for example by perforations to weaken the material along a fold, by scoring the sheet of material comprising the container, or simply by compressing the material along a fold line. In the drawings fold lines are shown by solid lines, and perforations are shown by dash lines unless otherwise provided in the text.

The blank 22 includes a series of four generally rectangular sidewall panels 16, 17, 18 and 19, which are interconnected along fold lines 21. Each sidewall panel has a first end and an opposite second end, each end being disposed adjacent respective endwall panels. A connecting panel 20, having a trapezoidal shape, is connected along a fold line 21 to the sidewall panel 16. One of the sidewall panels 17 has an opening 23 formed therethrough of a substantially circular shape. The opening 23 is fully defined by sidewall panel 17, and the opening further comprises four tabs 24 that are formed in a spaced apart relationship circumferentially with the opening 23. The tabs 24 are shown in FIG. 2 by dashed lines that represent hidden lines rather than perforated lines. The tabs 24 define a surface area having a radial distance s and an average arc distance t. Each of the hand holds 14 are formed in the sidewall panel 17 by cutting an opening therethrough. In the preferred embodiment the hand holds 14 are generally ergonomically designed for receiving the fingertips and thumb of a person.

When the blank 22 is folded to form carton 12, sidewall panels 16, 17, 18 and 19 constitute the sides of the carton, and connecting panel 20 is glued or bonded by adhesive to sidewall panel 19. The connecting panel 20 is secured to the interior surface 25 of sidewall panel 19.

A plurality of endwall panels 26, 27, 28 and 29 are connected along fold lines 30 to the corresponding sidewall panels 16–19. The endwall panels 26–29 when the carton 12 is assembled define automatic ends 31 that are formed on a first end 32 and a second end 33 of the collapsible liquid container 10.

Endwall panels 26 and 28 define a pair of opposed interlocking panels that interlockingly engage when the carton is erected. Endwall panel 26 includes three portions or sections; a notch portion **26*a*, an attachment portion 26*b*, and a main portion 26*c*. In the preferred embodiment the three portions of the endwall panel 26 are integrally formed, with the attachment portion 26*b* being connected to the main body portion 26*c* along a perforation line 34. The notch portion 26*a* defines a surface 35 that slants inwardly for guiding the opposing panel 28 into a locking arrangement with endwall panel 26 when the container 10 is erected. The attachment portion 26*b* of endwall panel 26 is folded along the perforation line 34** to create a hinge line.

In transforming blank 22 into carton 12 it is necessary to glue the attachment portion **26*b* to the adjacent endwall panel 27. Endwall panel 27 defines a trapezoidal-shaped panel projecting outwardly from its respective sidewall panel a shorter distance than the other endwall panels 26, 28, and 29. The shortened endwall panel 27 projects less than one-half as far as the other endwall panels 26, 28, and 29 from their respective sidewall panels. The endwall panel 27 is shortened to avoid interference with the fluid tight flexible bag 13. Further, the shortened panel 27 does not extend outwardly far enough to reach a seam 13*a* formed on flexible bag 13**.

The endwall panel 28 includes three portions or sections; a notch portion **28*a*, an attachment portion 28*b*, and a main portion 28*c*. In the preferred embodiment the three portions of the endwall panel 28 are integrally formed, with the attachment portion 28*b* being connected to the main body portion 28*c* along a perforation line 36. The notch portion 28*a* defines a surface 37 that slants inwardly for guiding the opposing panel 26 into a locking arrangement with endwall panel 28. The attachment portion 28*b* of endwall panel 28 is folded along the perforation line 36** to create a hinge line.

In manipulating blank 22 into carton 12 it is necessary to glue the attachment portion **28*b* to the adjacent endwall panel 29. The endwall panels function, as generally known to a person of ordinary skill in the art, to hold the sidewall panels apart when the collapsible container 10 is erected and define an interior volume within the container. When the container 10 is manipulated from a collapsed state to an erect state the notches 26*a* and 28*a*** are drawn into an interlocking arrangement.

Figure 3:
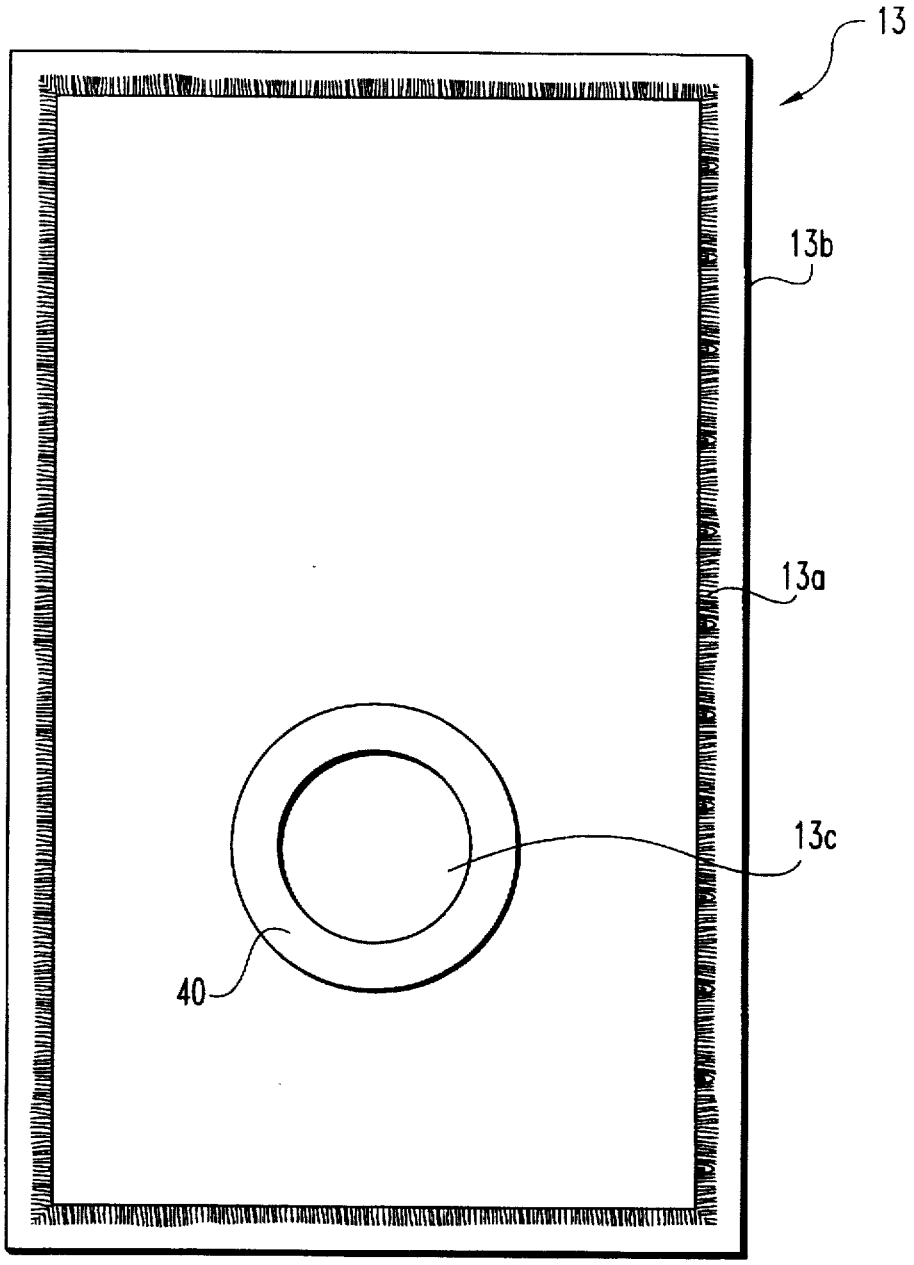
FIG. 3 is a top plan view of the flexible liquid tight bag of FIG. 2.

The liquid tight flexible bag 13 illustrated in FIG. 3 is of a substantially rectangular shape. The bag 13 is designed for holding a significant quantity of substance, such as soda, water, or juice. In the preferred embodiment the bag 13 is of a double wall construction with a seam **13*a* adjacent the perimeter 13*b* of the bag 13. It is also contemplated that another form of the bag 13 is constructed of a single wall, triple wall, or other combination of walls. The bag is constructed of substantially transparent fluid tight material that enables the substance placed in the bag 13 to be viewed through the fill level indicator 15. An opening 13*c* is formed in the bag 13 to allow the passage of material into and out of the bag. The opening 13*c* defines a substantially circular shape, that is sized to allow the rapid filling of the container 10. During the filling of the container 10, any air in bag 13 is displaced by the substance filling the bag and is vented through the opening 13*c*. A spout 40 is securely attached around the opening 13*c* formed in the bag 13. In the preferred embodiment a fluid tight seal is obtained between the bag 13 and the spout 40 by bonding the bag and the spout together in the area surrounding the opening 13*c***.

The bag 13 is affixed to sidewall panel 27 such that the opening **13*c* in bag 13 corresponds with opening 23 in blank 22. In the preferred embodiment the bag 13 is attached to the carton 12 along a first pair of glue lines 41 and a second pair of glue lines 42. Glue lines 41 are disposed across a portion of the shortened endwall panel 27, the fold line 30, and sidewall panel 17. The other pair of glue lines 42 are disposed across the fold lines 21 interconnecting the sidewall panel 17 with adjacent sidewall panels 16 and 18. The glue lines 42 generally run the substantial length of the respective sidewall panels. The glue lines 41 and 42 securely attach the flexible bag 13 to the blank 22, and facilitate the unfolding of bag 13 when the collapsible container 10** is manipulated into an erect condition.

Figure 4:
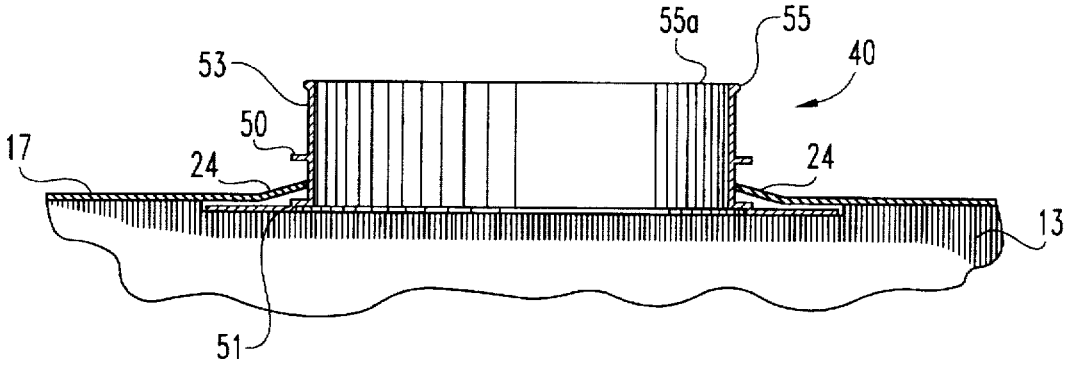
FIG. 4 is an enlarged side elevational view in full section of the spout of the collapsible liquid container of FIG. 1.

With reference to FIG. 4, there is illustrated the spout 40 that is affixed to the bag 13 and engages the tabs 24 formed in sidewall panel 17. The spout 40 has a substantially cylindrical shape and is formed of a substantially rigid material, such as plastic. A pair of annular rings 50 and 51 are formed circumferentially around the outer surface 53 of spout 40. The annular rings 50 and 51 project outwardly from the outer surface 53 of spout 40 to form an annular stop ring that retains the tabs 24. The tabs 24 engage the outer surface 53 of the spout 40 between the upper ring 50 and the lower rings 51. The rings 50 and 51 function as a stop to limit the bending of tabs 24, thereby securing the spout 40 securely to the carton 12. Further, a glue line 45 is applied adjacent the spout 40 to assist in securing the spout to container 12. Furthermore, spout 40 defines a protuberance 55 formed circumferentially around the end 55*a* of spout 40. The protuberance 55 projects outwardly from the spout 40, and is designed to receive a lid 11 thereon. A commercially available lid such as a Sweetheart four oz. lid will engage the protuberance 55.

Figure 5:
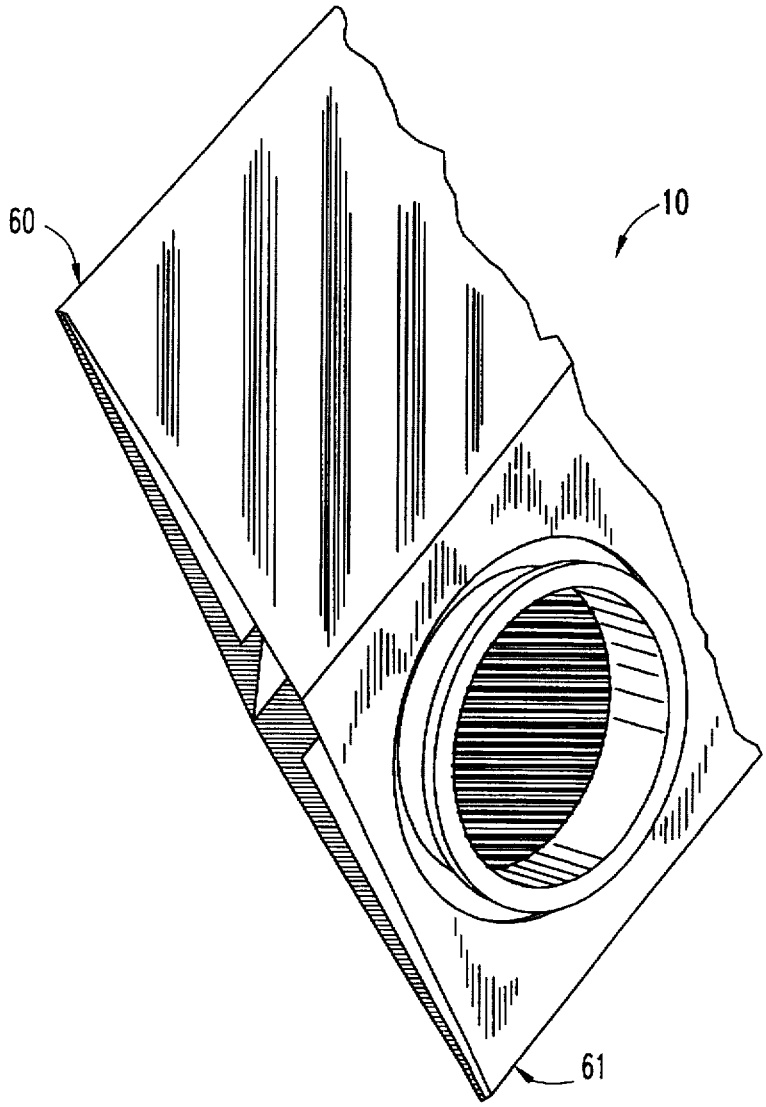
FIG. 5 is a perspective view of the collapsible liquid container of FIG. 1 in a fully collapsed condition.
Figure 6:
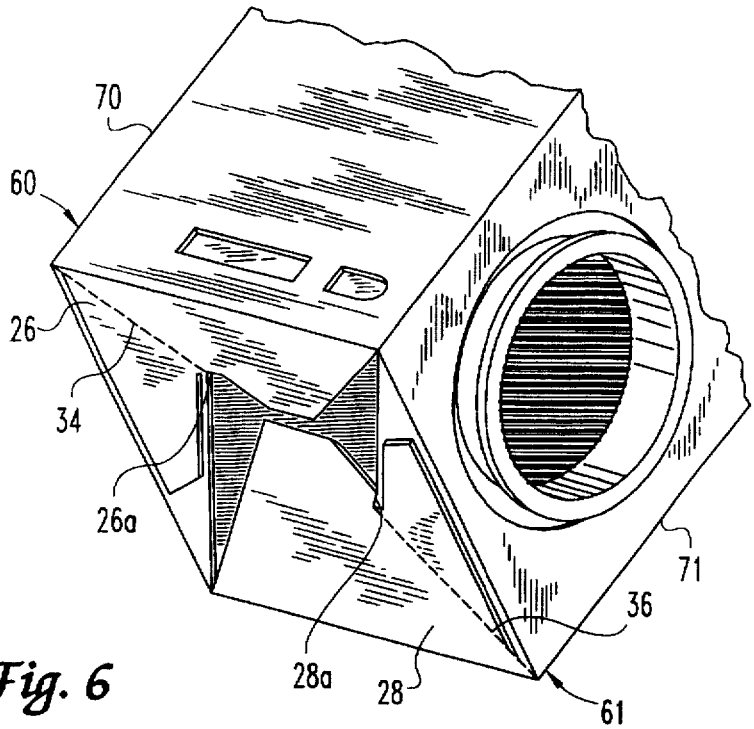
FIG. 6 is a partial perspective view of the collapsible liquid container of FIG. 1 in a partially collapsed condition.
Figure 7:
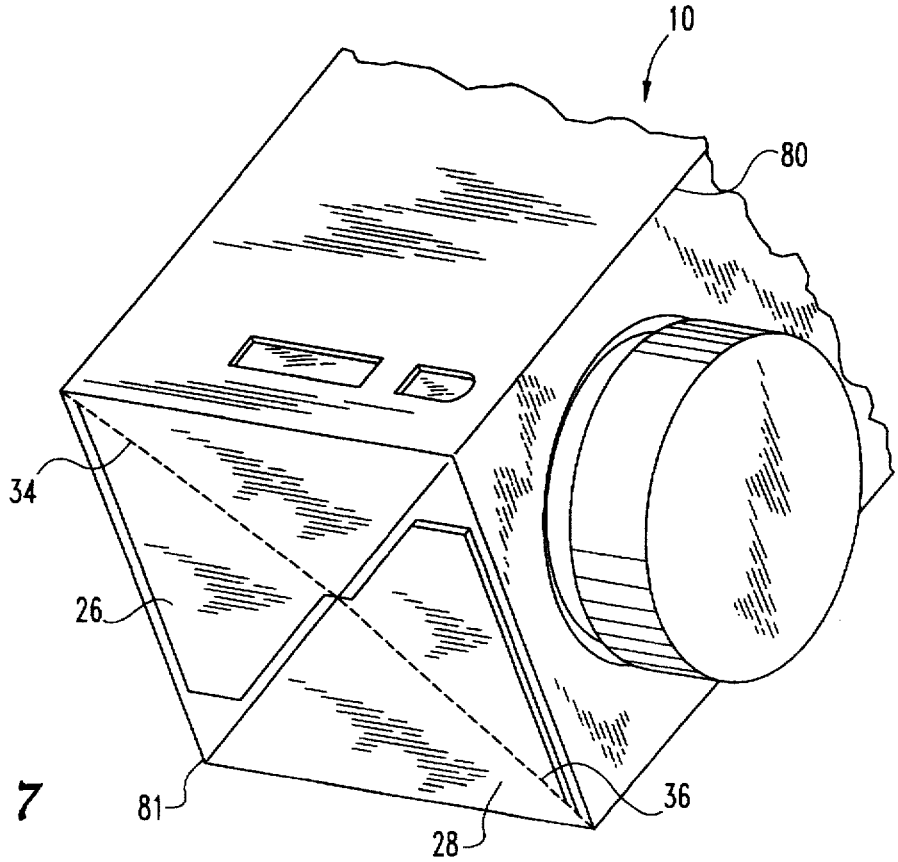
FIG. 7 is a partial perspective view of the collapsible liquid container of FIG. 1 in a fully erect condition.

With reference to FIGS. 5–7, the unfolding or erecting of collapsible container 10 will be described. The initial step in erecting the collapsible liquid container 10 is to obtain a folded container from storage. The container 10 is oriented such that a force can be applied in the direction of arrows 60 and 61. Note that the arrows 60 and 61 are coplanar with the perforation line 34 of endwall panel 26, and perforation line 36 of endwall panel 28. The attendant or consumer applies a force sufficient to drive the interlocking endwall panels 26 and 28 into an interengaged and locked position. In a locked position the notches 26*a* and 28*a* will be disposed adjacent one another. The container 10 is fully erected when the endwall panels 26 and 28 are disposed in the corresponding physical relationship that is illustrated in FIG. 6.

An example of filling the collapsible container 10 will now be illustrated in conjunction with the drawings. The first step is to provide a collapsible container 10 in a collapsed state having a bag 13 disposed therein. After obtaining the container 10 the attendant must expand the container 10 from a collapsed state into an erect state. The expanding is accomplished by asserting a force on the corners 70 and 71 of the container 10 in the direction of arrows 60 and 61. This application of force to the folded container 10 drives the interlocking panels 26 and 28 together, thereby interlocking the respective notches 26*a* and 28*a* of the endwall panels to maintain the container in an erect condition. A quantity of material, such as water, soda or juice is now dispensed through the spout 40, that corresponds with the opening 13*c* of bag 13, into the container 10 for storage and/or transportation. To eliminate or minimize any spillage from the container 10 a lid 11 is secured to the spout 40. In the preferred embodiment the lid 11 is pressed over the protuberance 55 defined circumferentially around the end 55*a* of the spout 40.

The collapsible container 10 is designed and manufactured to allow the container to be folded or collapsed after the material contained therein has been removed. The collapsing of the container 10 requires the assertion of a force on the corners 80 and 81 of the container 10. Further, the container 10 can be readily disassembled into its components, namely a carton 12, a flexible bag 13, and a lid 11, if desired to make the product more environmentally sound. Upon disassembly the bag 13 can be readily separated from carton 12, and the different materials can be reprocessed in an appropriate manner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A collapsible container, comprising:

a plurality of sidewall panels hingedly attached to adjacent ones of said sidewall panels along hinge lines, each said sidewall panel having a first end and an opposite second end, said plurality of sidewall panels including a first sidewall panel having an opening therein for receiving a bag opening therein;

first and second opposed automatic ends respectively disposed at said first end and said second end of said sidewall panels, at least one of said automatic ends comprising a plurality of endwall panels hingedly attached to the respective ends of said sidewall panels, one pair of said endwall panels defining opposed interlocking panels, each said one pair of said end wall panels having a notch formed thereon and upon erection of the container the notches interlocking engage; and a liquid tight flexible bag within the container for holding a volume of material, said bag having an opening therein aligned in said opening in said first sidewall panel, said bag being secured to the container along a substantial portion of said hinge lines connecting said first sidewall panel to said plurality of sidewall panels and further secured along a substantial portion of at least one of of said sidewall panel ends so as to facilitate the unfolding of said bag when the container is manipulated into an erect condition.

2. The collapsible container of claim 1, wherein at least one of said interlocking panels is secured to one of said endwall panels disposed adjacent said interlocking panel.

3. The collapsible container of claim 2, wherein upon erection of said container said plurality of endwall panels hold said sidewall panels apart to define an inner volume.

4. The collapsible container of claim 3, wherein said sidewall panels and said endwall panels are integrally formed.

5. The collapsible container of claim 4, wherein said plurality of sidewall panels comprises four sidewall panels, and wherein said plurality of endwall panels comprises four endwall panels at each said automatic end.

6. The collapsible container of claim 5, wherein said flexible bag opening defines a spout.

7. The collapsible container of claim 1, wherein said bag is secured along its perimeter adjacent the hinge lines connecting said first sidewall panel to said plurality of sidewall panels and wherein said bag is secured along it's perimeter between said first sidewall panel and said respective sidewall attached thereto.

8. The collapsible container of claim 7, wherein said shortened endwall panel is trapezoidal.

9. The collapsible container of claim 8, wherein at least one of said sidewall panels defines a hand hold.

10. A collapsible container, comprising:

a plurality of sidewall panels hingedly attached to adjacent ones of said sidewall panels along hinge lines, each said sidewall panels having a first end and an opposite second end, at least one of said sidewall panels defining an opening therein for receiving a bag opening therein;

a liquid tight flexible bag within the container for holding a volume of material, at least a portion of said bag being secured to the container with a bag opening aligned in said opening of said sidewall; and first and second opposed integrally formed automatic ends respectively disposed at said first end and said second end of said sidewall panels, wherein each of said automatic ends comprises a plurality of endwall panels hingedly attached to the respective ends of said sidewall panels, one pair of said endwall panels being opposed interlocking panels, each of said opposed interlocking panels having a notch thereon and upon erection of the container the notches forming a locking arrangement, at least one of said automatic ends having non interference means associated therewith for minimizing interference with said bag as the container is erected.

11. The collapsible container of claim 10, wherein each said interlocking panels is secured to one of said endwall panels disposed adjacent said interlocking panel.

12. The collapsible container of claim 11, wherein upon erection of said container said plurality of endwall panels holds said sidewall panels apart to define an inner volume.

13. The collapsible container of claim 12, wherein said sidewall panels and said endwall panels are integrally formed.

14. The collapsible container of claim 13, wherein said flexible bag opening defines a spout.

15. The collapsible container of claim 14, wherein at least a portion of said bag is secured along the hinge lines adjacent said sidewall panel defining an opening therein for receiving said bag opening, and wherein at least a portion of said bag is secured between said sidewall panel defining an opening therein and said respective endwall attached thereto.

16. A collapsible container, comprising:

a plurality of sidewall panels hingedly attached to adjacent ones of said sidewall panels along hinge lines, each of said sidewall panels having a first end and an opposite second end, said plurality of sidewall panels including a first sidewall panel positioned between adjacent ones of said sidewall panels, said first sidewall panel having an opening therein for receiving a bag opening therein;

first and second opposed integrally formed automatic ends respectively disposed at said first end and said second end of said sidewall panels, wherein each of said automatic ends comprises a plurality of endwall panels hingedly attached to the respective ends of said sidewall panels, one pair of said endwall panels being opposed interlocking panels, each of said opposed interlocking panels having a notch thereon and upon erection of the container the notches forming a locking arrangement; and a liquid tight flexible bag having a bag opening therein, said bag secured to the container so that said bag opening is aligned in said opening of said first sidewall panel and the container adapted for non-automated expansion from a collapsed mode to an expanded mode, wherein said bag unfolds within the container during the non-automated expansion of the container.

* * * * *